US008113019B2

(12) United States Patent
Yoon

(10) Patent No.: US 8,113,019 B2
(45) Date of Patent: Feb. 14, 2012

(54) DRUM TYPE WASHING MACHINE FOR PREVENTING WATER FROM PENETRATING INTO A BEARING

(75) Inventor: Seong-No Yoon, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 753 days.

(21) Appl. No.: 12/186,337

(22) Filed: Aug. 5, 2008

(65) Prior Publication Data

US 2009/0038349 A1 Feb. 12, 2009

(30) Foreign Application Priority Data

Aug. 6, 2007 (KR) ..... 10-2007-0078732

(51) Int. Cl.
*D06F 21/00* (2006.01)
*D06F 23/00* (2006.01)
*D06F 25/00* (2006.01)

(52) U.S. Cl. ..... 68/140

(58) Field of Classification Search ..... 68/140
See application file for complete search history.

(56) References Cited

U.S. PATENT DOCUMENTS 6,062,049 A * 5/2000 Martinsson ..... 68/140
6,148,647 A * 11/2000 Kabeya et al. ..... 68/140

FOREIGN PATENT DOCUMENTS

DE 10342254 B3 * 11/2004
JP 10-20020037814 A 5/2002
KR 10-2005-0000093-1 3/2005

OTHER PUBLICATIONS

DE 103 42 254 English Translation Nov. 2004 Germany Eckert et al.*

* cited by examiner

*Primary Examiner* — Michael Barr
*Assistant Examiner* — Charles W Kling
(74) *Attorney, Agent, or Firm* — Birch, Stewart, Kolasch & Birch, LLP

(57) ABSTRACT

Disclosed is a drum type washing machine. The drum type washing machine includes a sealing member for preventing water between a tub and a drum from penetrating into a bearing for supporting a rotation shaft and a water penetration preventing unit for preventing the water between the tub and the drum from penetrating into the sealing member. Accordingly, it is doubly prevented that the water between the tub and the drum penetrates into the bearing, thereby preventing corrosion of the bearing due to the water. As a result, it is capable of preventing vibration and noise caused by the corrosion of the bearing and of stably supporting the rotation shaft with maintaining the initial performance of the bearing, thereby preventing the drum type washing machine from being out of order.

5 Claims, 4 Drawing Sheets

【Fig. 1】
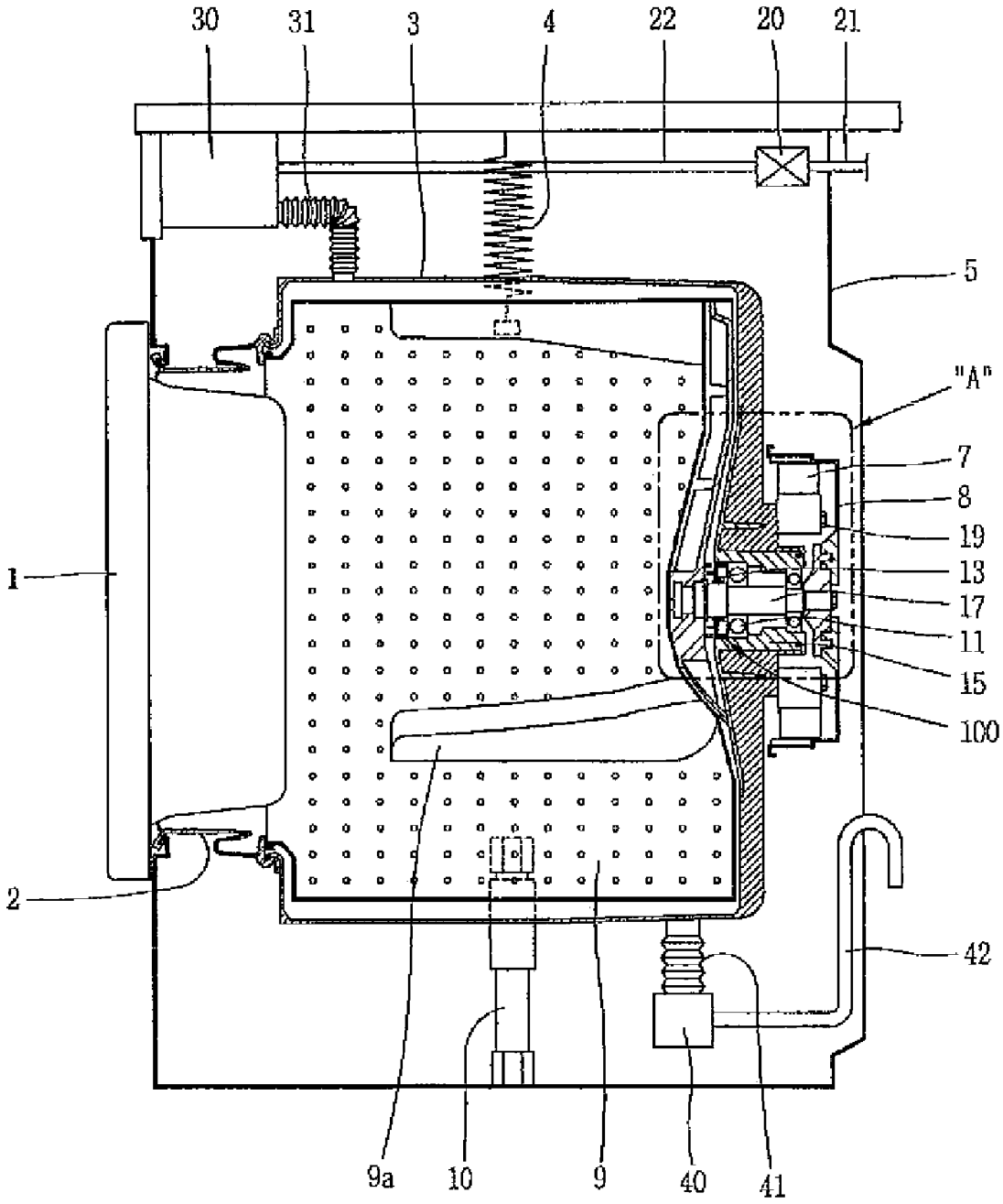

【Fig. 2】
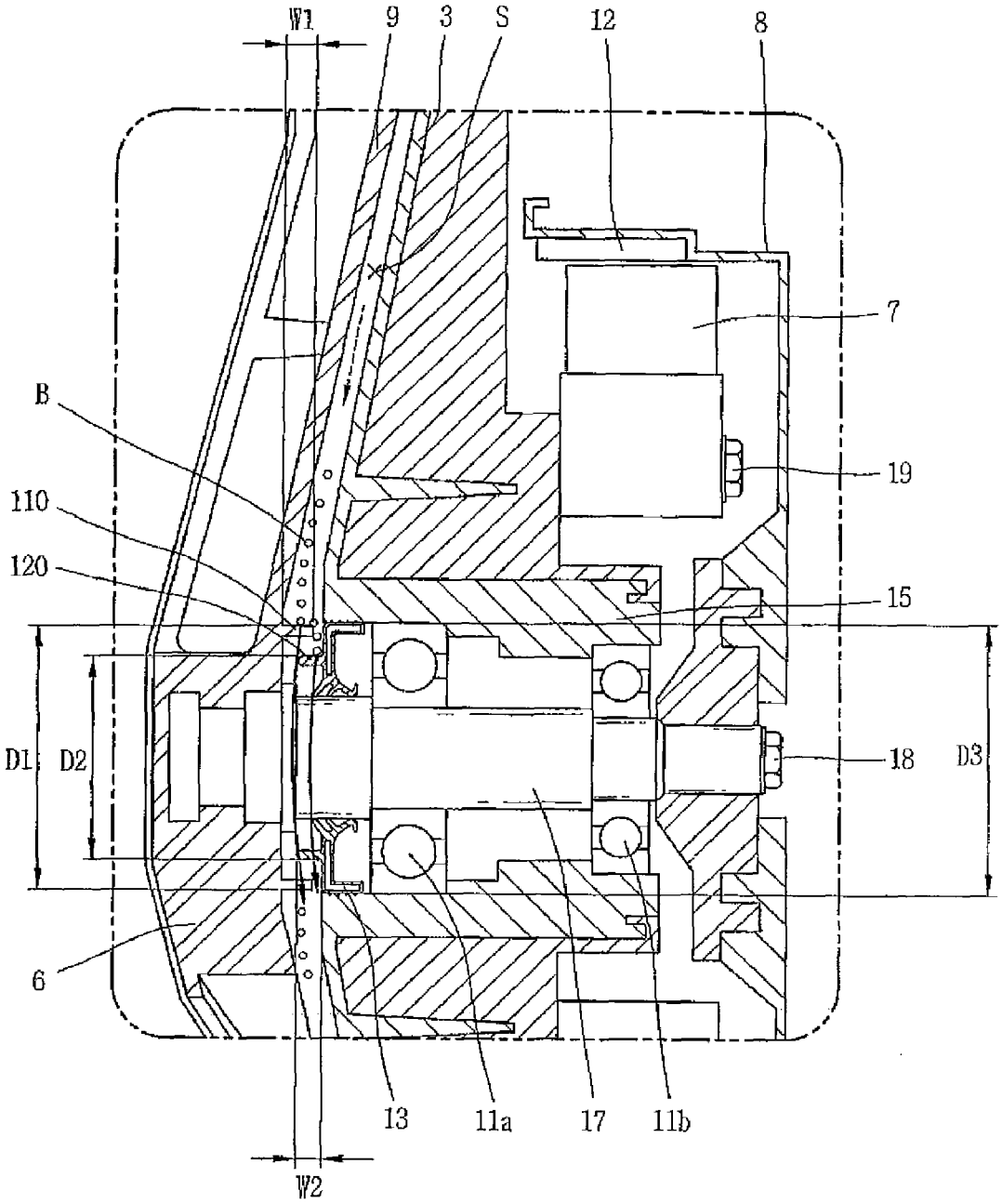

【Fig. 3】
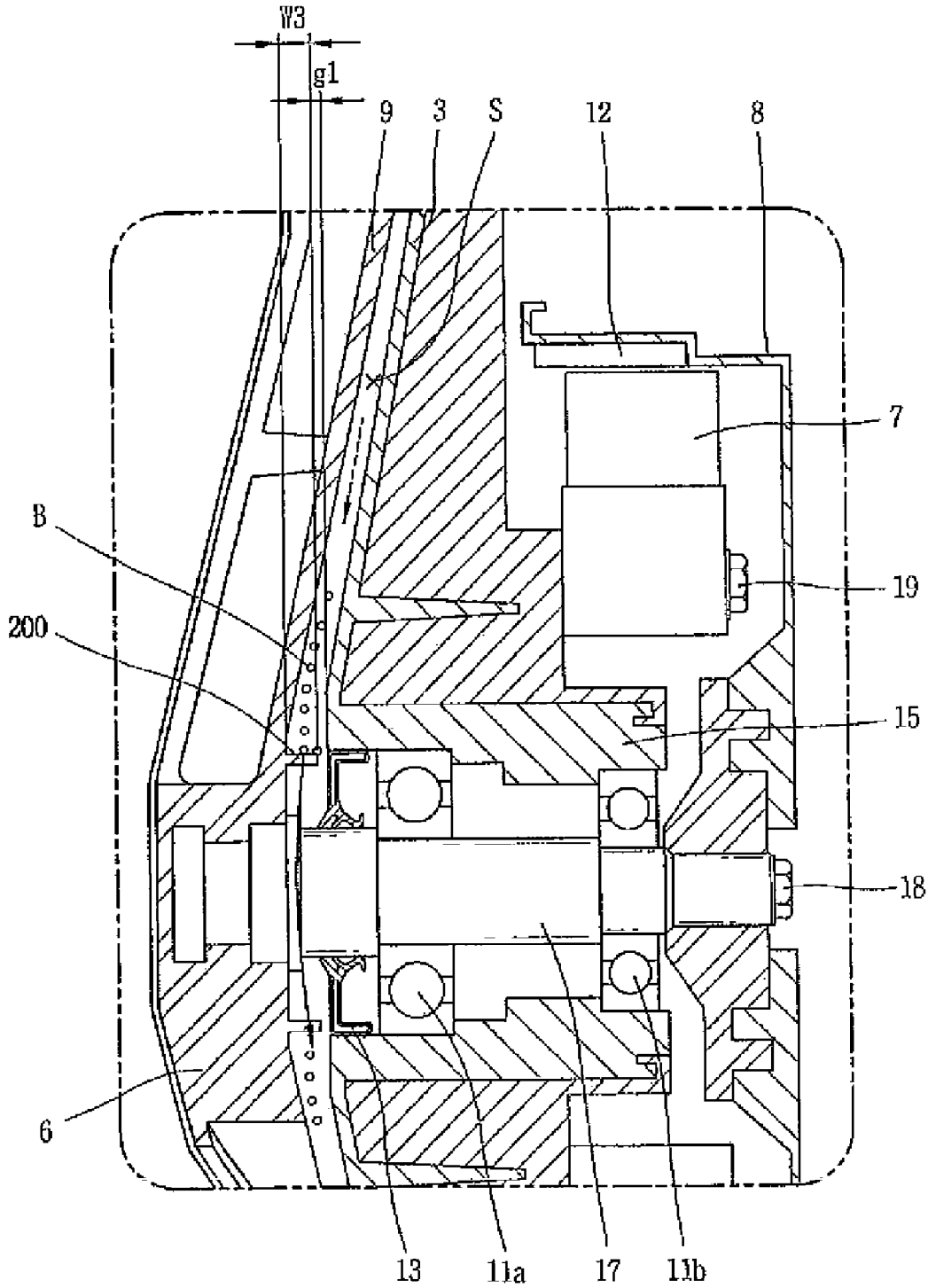

【Fig. 4】
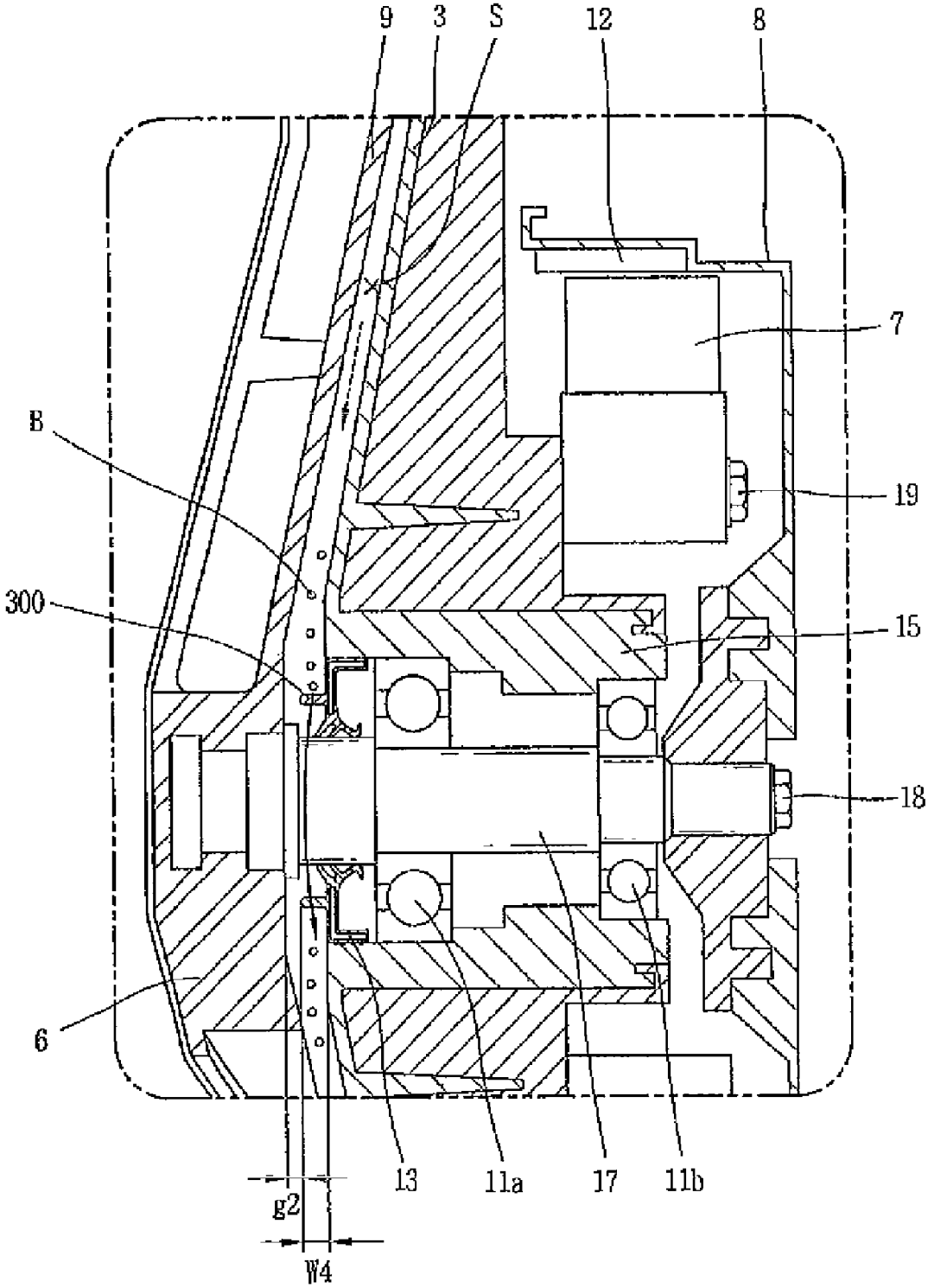

DRUM TYPE WASHING MACHINE FOR PREVENTING WATER FROM PENETRATING INTO A BEARING

BACKGROUND OF THE INVENTION

1. Field of the Invention

The present invention relates to a drum type washing machine.

2. Description of the Related Art

In general, a drum type washing machine serves to wash laundry by using a friction force between a rotating drum and the laundry and the laundry dropping from a top to a bottom in the rotating drum. Accordingly, in the drum type washing machine, the laundry is little damaged and is not entangled.

The drum type washing machine includes a tub for holding water therein, a drum rotatably installed in the tub and receiving laundry therein, a driving motor is installed at a rear side of the drum so as to rotate the drum, a rotation shaft for transferring a driving force from the driving motor to the drum, a bearing for supporting the rotation shaft, and a sealing member installed on an outer circumferential surface of the rotation shaft in front of the bearing so as to prevent water between the tub and the drum from penetrating into the bearing.

Even though the sealing member is provided in front of the bearing, it is impossible to perfectly prevent the water between the tub and the drum from penetrating into the bearing through a gap between the sealing member and the rotation shaft.

Once the water penetrates into the bearing, the bearing is corroded. Then the corroded bearing cannot stably support the rotation shaft, which results in shaking of the rotation shaft and the drum. As a result, vibration and noise generated while the drum type washing machine is operated, which causes the drum type washing machine to be out of order.

SUMMARY OF THE INVENTION

To solve the aforementioned problems, in accordance with one aspect of the present invention, there is provided a drum type washing machine comprising: a tub; a drum rotatably installed in the tub; a driving motor for rotating the drum; a rotation shaft for transferring a rotational force from the driving motor to the drum; a bearing for supporting the rotation shaft; a sealing member for preventing water from penetrating into the bearing; and a water penetration preventing unit for preventing the water from penetrating into the sealing member.

Preferably, the water penetration preventing unit is implemented as a rib formed at a spider connecting the rotation shaft and the drum to each other or a is rib formed at the sealing member.

Alternately the water penetration preventing unit is implemented as a first rib formed at a spider connecting the rotation shaft and the drum to each other and a second rib formed at the sealing member, preferably. Here, an external diameter of the first rib is larger than that of the second rib, and the first rib and the second rib are overlapped with each other in a length direction, preferably.

In accordance with another aspect of the present invention, there is provided a drum type washing machine comprising: a tub; a drum rotatably installed in the tub; a driving motor for rotating the drum; a rotation shaft for transferring a rotational force from the driving motor to the drum; front and rear bearings for supporting the rotation shaft; a sealing member insertedly installed on an outer circumferential surface of the rotation shaft in front of the front bearing; and a rib formed at a spider connecting the rotation shaft and the drum to each other or formed at the sealing member. Here, it may be doubly prevented that water between the tub and the drum penetrates into the front and rear bearings by the sealing member and the rib.

Here, the rib is formed at the spider in a cylindrical shape, and is extended toward the sealing member with a length so as to form a gap between the rib and the sealing member, preferably.

Alternately the rib is formed at the sealing member in a cylindrical shape, and is extended toward the spider with a length so as to form a gap between the rib and the spider, preferably.

In accordance with still another aspect of the present invention, there is provided a drum type washing machine comprising: a tub; a drum rotatably installed in the tub; a driving motor for rotating the drum; a rotation shaft for transferring a rotational force from the driving motor to the drum; front and rear bearings for supporting the rotation shaft; a sealing member insertedly installed on an outer circumferential surface of the rotation shaft in front of the front bearing; a first rib formed at a spider connecting the rotation shaft and the drum to each other; and a second rib formed at the sealing member. Here, an external diameter of the first rib may be larger than that of the second rib, and the first rib and the second rib may be overlapped with each other in a length direction.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate preferred embodiments of the invention and together with the description serve to explain the principles of the invention.

In the drawings:

FIG. 1 is a schematic view showing a drum type washing machine in accordance with one embodiment of the present invention;

FIG. 2 is an enlarged view of "A" portion in FIG. 1;

FIG. 3 is a diagram showing a variation of a water penetration preventing unit of FIG. 2; and FIG. 4 is a diagram showing another variation of the water penetration preventing unit of FIG. 2.

DETAILED DESCRIPTION OF THE INVENTION

Description will now be given in detail of the preferred embodiments of the present invention, examples of which are illustrated in the accompanying drawings.

Hereafter, a drum type washing machine in accordance with one embodiment of the present invention will be described in detail. FIG. 1 is a schematic view showing the drum type washing machine in accordance with the one embodiment of the present invention, and FIG. 2 is an enlarged view of "A" portion in FIG. 1.

Referring to FIGS. 1 and 2, the drum type washing machine in accordance with the one embodiment of the present invention includes a cabinet 5 forming an external appearance, a tub 3 installed in the cabinet 5 so as to hold water therein, a drum 9 rotatably installed in the tub 3 and receiving laundry therein, driving motors 7, 8 for rotating the drum 9, a rotation shaft 17 for transferring a rotational force from the driving motors 7, 8 to the drum 9, a bearing 11 for supporting the rotation shaft 17, a sealing member 13 for preventing water between the tub 3 and the drum 9 from penetrating into the bearing 11, and a water penetration preventing unit 100 for preventing the water between the tub 3 and the drum 9 from penetrating into the sealing member 13.

A door 1 is disposed at a front side of the cabinet 5, and a gasket 2 is installed between the door 1 and the tub 3. A locking spring 4 for supporting the tub 3 is installed between an upper inner surface of the cabinet 5 and an outer upper surface of the tub 3. A friction damper 10 for reducing vibration of the tub 3 is installed between a lower inner surface of the cabinet 5 and an outer lower surface of the tub 3.

A detergent supply device 30 for supplying detergent to the tub 3 is disposed at a front upper side of the cabinet 5. The detergent supply device 30 serves to mix the detergent with water and to supply the mixture to the tub 5 through a supply pipe 31.

A water supply device 20 consisted of a plurality of valves for supplying water to the detergent supply device 30 is disposed at a rear upper side of the cabinet 5. And, a supply pipe 21 connected to an external water supply source and a connection pipe 22 connected to the detergent supply device 30 are respectively installed at the water supply device 20.

A drain pump 41 for draining the water stored in the tub 3 by outwardly pumping it is installed at a rear lower side of the cabinet 5. And, a drain pipe 41 connected to the lower side of the tub 3 and a connection pipe 42 connected to an external drain are respectively installed at the drain pump 40.

A plurality of lifters 9*a* for moving the laundry up and down are disposed in the drum 9.

The driving motors 7, 8 consist of a stator 7 implemented as a direct drive type motor and provided with a coil wound at a slot, and a rotor 8 rotated at an outer circumferential surface of the stator 7 and provided with a permanent magnet 12 therein.

The stator 7 is coupled to a rear wall of the tub 3 by a plurality of coupling member 19.

The rotor 8 is coupled to a rear end of the rotation shaft 17 by a coupling member 18.

With such configuration, once the coil of the stator 7 receives a power and thus to become electromagnetic, the rotor 8 is rotated by an interaction between the coil of the stator 7 and the permanent magnet 12 attached in the rotor 8. A rotational force of the rotor 8 is transferred to the drum 9 through the rotation shaft 17.

The bearing 11 is installed in a bearing housing 15 and includes a front bearing 11*a* positioned at a front side of the rotation shaft 17 and a rear bearing 11*b* positioned at a rear side of the rotation shaft 17.

The sealing member 13 installed on the outer circumferential surface of the rotation shaft 17 in front of the front bearing 11*a*, thereby preventing water B between the tub 3 and the drum 9 from penetrating into the bearing 11.

The water penetration preventing unit 100 includes a first rib 110 having a cylindrical shape and formed at a spider 6 connecting the rotation shaft 17 and the drum 9 to each other, and a second rib 120 having a cylindrical shape and formed at the sealing member 13.

Here, an external diameter D1 of the first rib 110 is larger than an external diameter D2 of the second rib 120. Alternately, the external diameter D1 of the first rib 110 may be smaller than the external diameter D2 of the second rib 120. Even in the second case, the external diameter D1 of the first rib 110 should not be larger than an external diameter D3 of the sealing member 13. In other words, the external diameter D1 of the first rib 110 should be same as or smaller than the external diameter D3 of the sealing member 13.

If the external diameter D2 of the first rib 110 is larger than the external diameter D3 of the sealing member 13, the first rib 110 is positioned out of a central portion of the spider 6. Then, due to a structure of the spider 6, a gap through which water can penetrate is generated between the spider 6 and the first rib 110, accordingly an effect with respect to preventing of water penetration may is be deteriorated.

In the meantime, the first rib 110 is extended toward the sealing member 13 and the second rib 120 is extended toward the spider 6 so that a length W1 of the first rib 110 and a length W2 of the second rib 120 may be overlapped with each other in a length direction.

By the first rib 110 and the second rib 120, it is capable of preventing water dropping to the first rib 110 or the second rib 120 from approaching the sealing member 13.

Hereafter, an operation principle of the water penetration preventing unit will be described.

While washing, rinsing or dehydrating, water kept in the drum 9 or at the lower portion of the tub 3 is splashed to an upper inner wall of the tub 3 by the rotational force of the drum 9. Some of the water drops through an interval S between the tub 3 and the drum 9. The water B dropping through the interval S between the tub 3 and the drum 9 drops to the first rib 110 or the second rib 120 in a direction of dotted line arrow.

The water dropping to the first rib 110 is splashed from the outer circumferential surface of the first rib 110 in a direction of solid line arrow by the rotational force of the rotating drum 9.

The water dropping to the second rib 120 flows down along the outer circumferential surface of the second rib 120 in the direction of solid line arrow.

By the first rib 110 and the second rib 120, it is capable of preventing the water from approaching the sealing member 13.

Thus, by the first rib 110 and the second rib 120 and the sealing member 13, it is capable of doubly preventing the water between the tub 3 and the drum 9 from penetrating into the bearing 11.

Accordingly, it is capable of preventing vibration and noise caused by corrosion of the bearing 11, and of stably supporting the rotation shaft 17 with maintaining its initial performance of the bearing 11, thereby being capable of preventing the drum type washing machine from being out of order.

FIG. 3 is a diagram showing a variation of a water penetration preventing unit of FIG. 2.

Referring to FIG. 3, a water penetration preventing unit 200 is a cylindrical rib formed at the spider 6. Here, the rib is extended toward the sealing member 13 as long as the rib does not come into contact with the sealing member 13. That is, the rib has a length W3 so that an interval between the rib and the sealing member 13 may be a minimum gap g1. Accordingly, the water penetration preventing unit 200 has a length W3 longer than the length W1 (refer to FIG. 2) of the first rib 110 (refer to FIG. 2).

When the water penetration preventing unit 200 is formed only at the spider 6, even though water may penetrate into the bearing 11 through the gap g1, it is capable of simplifying the configuration and of reducing a cost, in comparison with the ribs formed both at the spider 6 and the sealing member 13.

Hereafter, an operation principle of the water penetration preventing unit will be described.

While washing, rinsing or dehydrating, water kept in the drum 9 or at the lower portion of the tub 3 is splashed to an upper inner wall of the tub 3 by the rotational force of the drum 9. Some of the water drops through an interval S between the tub 3 and the drum 9. The water B dropping through the interval S between the tub 3 and the drum 9 drops to the rib 200 in a direction of dotted line arrow.

The water dropping to the rib 200 is splashed from the outer circumferential surface of the rib 200 in a direction of solid line arrow by the rotational force of the rotating drum 9.

By the rib 200, it is capable of preventing the water from approaching the sealing member 13.

Thus, by the rib 200 and the sealing member 13, it is capable of doubly preventing the water between the tub 3 and the drum 9 from penetrating into the bearing 11.

Accordingly, it is capable of preventing vibration and noise caused by corrosion of the bearing 11, and of stably supporting the rotation shaft 17 with maintaining its initial performance of the bearing 11, thereby being capable of preventing the drum type washing machine from being out of order.

FIG. 4 is a diagram showing another variation of a water penetration preventing unit of FIG. 2.

Referring to FIG. 4, a water penetration preventing unit 300 is a cylindrical rib formed at the sealing member 13. Here, the rib is extended toward the spider 6 as long as the rib does not come into contact with the spider 6. That is, the rib has a length W4 so that an interval between the rib and the sealing member 13 may be a minimum gap g2. Accordingly, the water penetration preventing unit 300 has the length W4 longer than the length W2 (refer to FIG. 2) of the second rib 120 (refer to FIG. 2).

When the water penetration preventing unit 300 is formed only at the sealing member 13, even though water may penetrate into the bearing 11 through the gap g2, it is capable of simplifying the configuration and of reducing a cost, in comparison with the ribs formed both at the spider 6 and the sealing member 13.

Hereafter, an operation principle of the water penetration preventing unit will be described.

While washing, rinsing or dehydrating, water kept in the drum 9 or at the lower portion of the tub 3 is splashed to an upper inner wall of the tub 3 by the rotational force of the drum 9. Some of the water drops through an interval S between the tub 3 and the drum 9. The water B dropping through the interval S between the tub 3 and the drum 9 drops to the rib 300 in a direction of dotted line arrow.

The water dropping to the rib 300 flows down along the outer circumferential surface of the rib 300 in a direction of solid line arrow.

By the rib 300, it is capable of preventing the water from approaching the sealing member 13.

Thus, by the rib 300 and the sealing member 13, it is capable of doubly preventing the water between the tub 3 and the drum 9 from penetrating into the bearing 11.

Accordingly, it is capable of preventing vibration and noise caused by corrosion of the bearing 11, and of stably supporting the rotation shaft 17 with maintaining its initial performance of the bearing 11, thereby being capable of preventing the drum type washing machine from being out of order.

Meanwhile, the drum type washing machine in the aforementioned embodiment is provided with a horizontal drum, however the present invention can be applied to a drum type washing machine having a drum inclined in a specific angle.

The drum type washing machine in accordance with the one embodiment of the present invention includes the sealing member for preventing water between the tub and the drum from penetrating into the bearing for supporting the rotation shaft, and the water penetration preventing unit for preventing the water between the tub and the drum from penetrating into the sealing member. Accordingly, it is capable of doubly preventing the water between the tub and the drum from penetrating into the bearing and thus to prevent corrosion of the bearing due to the water. Accordingly, it is capable of vibration and noise caused by the corrosion of the bearing, and of stably supporting the rotation shaft with maintaining the initial performance of the bearing, thereby preventing the drum type washing machine from being out of order.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present inventive features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A drum type washing machine comprising:

a tub;

a drum rotatably installed in the tub;

a driving motor for rotating the drum;

a rotation shaft for transferring a rotational force from the driving motor to the drum;

a bearing for supporting the rotation shaft;

a sealing member for preventing water from penetrating into the bearing; and a water penetration preventing unit for preventing the water from penetrating into the sealing member, wherein the water penetration preventing unit is implemented as a first rib formed at a spider connecting the rotation shaft and the drum to each other, and a second rib formed at the sealing member, and wherein an external diameter of the first rib is larger than that of the second rib and the same as or smaller than that of the sealing member.

2. The washing machine of claim 1, wherein the first rib and the second rib are overlapped with each other in a length direction.

3. The washing machine of claim 1, wherein the first rib is formed at the spider in a cylindrical shape, and is extended toward the sealing member with a length so as to form a gap between the rib and the sealing member.

4. The washing machine of claim 1, wherein the second rib is formed in a cylindrical shape, and is extended toward the spider with a length so as to form a gap between the rib and the spider.

5. A drum type washing machine comprising:

a tub;

a drum rotatably installed in the tub;

a driving motor for rotating the drum;

a rotation shaft for transferring a rotational force from the driving motor to the drum;

front and rear bearings for supporting the rotation shaft;

a sealing member insertedly installed on an outer circumferential surface of the rotation shaft in front of the front bearing;

a first rib formed at a spider connecting the rotation shaft and the drum to each other; and a second rib formed at the sealing member, wherein an external diameter of the first rib is larger than that of the second rib, and the same as or smaller than that of the sealing member, and wherein the first rib and the second rib are overlapped with each other in a length direction.

* * * * *